US011314183B2

(12) United States Patent
Fujishima et al.

(10) Patent No.: US 11,314,183 B2
(45) Date of Patent: Apr. 26, 2022

(54) DEVELOPING DEVICE AND IMAGE FORMING APPARATUS THEREWITH

(71) Applicant: KYOCERA Document Solutions Inc., Osaka (JP)

(72) Inventors: Masashi Fujishima, Osaka (JP); Norio Kubo, Osaka (JP); Asami Sasaki, Osaka (JP); Yasuhiro Tauchi, Osaka (JP); Tamotsu Shimizu, Osaka (JP); Akira Matayoshi, Osaka (JP); Masaki Kadota, Osaka (JP); Koji Suenami, Osaka (JP); Yuji Toyota, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/322,298

(22) Filed: May 17, 2021

(65) Prior Publication Data

US 2021/0364944 A1 Nov. 25, 2021

(30) Foreign Application Priority Data

May 21, 2020 (JP) ..... JP2020-088922
Aug. 5, 2020 (JP) ..... JP2020-132839

(51) Int. Cl.
*G03G 15/08* (2006.01)

(52) U.S. Cl.
CPC ..... *G03G 15/0812* (2013.01); *G03G 15/0808* (2013.01); *G03G 15/0893* (2013.01)

(58) Field of Classification Search
CPC ..... G03G 15/0808; G03G 15/0893; G03G 15/0812
See application file for complete search history.

(56) References Cited

U.S. PATENT DOCUMENTS

2015/0003876 A1 1/2015 Iida et al. ..... 399/254
2018/0341196 A1* 11/2018 Saito ..... G03G 15/0891
2019/0187588 A1* 6/2019 Suzuki ..... G03G 15/0893
2020/0201204 A1* 6/2020 Kasukawa ..... G03G 15/0886

FOREIGN PATENT DOCUMENTS

JP 2015-11158 A 1/2015

* cited by examiner

*Primary Examiner* — Sevan A Aydin
(74) *Attorney, Agent, or Firm* — Stein IP, LLC

(57) ABSTRACT

A developing device includes a developer container, a developer carrier, and first and second stirring/conveying members. The developer container includes a first partition wall partitioning between the two conveying chambers longitudinally, a first communication portion for passing developer from the first to the second conveying chamber, a second communication portion for passing developer from the second to the first conveying chamber, a developer supply port for supplying developer in, a developer discharge portion for discharging excessive developer, a second partition wall arranged, adjacent to the regulating portion, downstream of the second communication portion to partition between the first conveying chamber and the regulating portion, and a shield portion connected to the two partition walls to bridge between them to shield a top part of the second communication portion. A gap is formed between an upper end part of the shield portion and the inner surface of the developer container.

10 Claims, 9 Drawing Sheets

DEVELOPING DEVICE AND IMAGE FORMING APPARATUS THEREWITH

INCORPORATION BY REFERENCE

This application is based on and claims the benefit of Japanese Patent Applications No. 2020-088922 filed on May 21, 2020 and No. 2020-132839 filed on Aug. 5, 2020, the contents of which are hereby incorporated by reference.

BACKGROUND

The present disclosure relates to developing devices used in image forming apparatuses employing electrophotography, such as copiers, printers, facsimile machines, and multifunction peripherals incorporating their functions, and to image forming apparatuses provided with such a developing device. More particularly, the present disclosure relates to developing devices which are supplied with two-component developer containing toner and carrier and which discharge excessive developer, and to image forming apparatuses provided with such a developing device.

In image forming apparatuses, a latent image formed on an image carrying member composed of a photosensitive member or the like is developed by a developing device to be visualized as a toner image. In one type of such developing devices, a two-component development system that uses two-component developer is adopted. This type of developing device stores two-component developer containing carrier and toner in a developer container, and includes a developing roller (developer carrying member) which supplies the developer to the image carrying member and a stirring/conveying member which supplies, while conveying and stirring, the developer in the developer container to the developing roller.

In the developing device employing the two-component development system, while toner is consumed as development operation proceeds, carrier remains in the developing device unconsumed. Thus stirred together with toner in the developer container, carrier degrades as it is stirred repeatedly. As a result, the electrostatic charging performance of carrier with respect to toner gradually degrades.

To cope with that, there has been proposed a developing device that employs a CASS (carrier auto streaming system) to supply developer containing carrier to the developer container and that discharges excessive developer, thereby preventing degradation in electrostatic charging performance.

Incidentally, the height of developer tends to decrease in a high-humidity environment and to increase in a low-humidity environment. This causes the weight of developer in the developer container to vary depending on the environment in which the image forming apparatus is used. There is thus concern for, when the environment changes from a high-humidity one to a low-humidity one, a sudden increase in the amount of developer discharged and, when the environment changes from a low-humidity one to a high-humidity one, development failure due to an insufficient height of developer.

For example, in a known developing device, a disk portion is provided in a path for discharging developer in the developing device toward a discharge port, and an end part of a reversing screw provided upstream of the disk portion in the discharging direction is arranged so as not to be joined to the disk portion. In this developing device, developer is restrained from being lifted up due to the disk portion being joined to a conveying portion upstream of the disk portion, and this contributes to a stable amount of developer discharged.

SUMMARY

According to one aspect of the present disclosure, a developing device includes a developer container, a developer carrying member, and first and second stirring/conveying members. The developer container includes first and second conveying chambers which are arranged parallel to each other, a first partition wall which partitions between the first and second conveying chambers along the longitudinal direction, a communication portion through which the first and second conveying chambers communicate with each other in opposite end parts of the first partition wall, a developer supply port through which developer containing magnetic carrier and toner is supplied, and a developer discharge portion which is provided in a downstream-side end part of the second conveying chamber and through which excessive developer is discharged. The developer carrying member is rotatably supported on the developer container and carries, on its surface, the developer in the second conveying chamber. The first stirring/conveying member includes a rotary shaft and a first conveying blade formed on the outer circumferential face of the rotary shaft and stirs and conveys the developer in the first conveying chamber in a first direction. The second stirring/conveying member includes a rotary shaft and a second conveying blade formed on the outer circumferential face of the rotary shaft and stirs and conveys the developer in the second conveying chamber in a second direction opposite to the first direction. The second stirring/conveying member includes a regulating portion, a discharging blade, and a disk. The regulating portion is formed adjacent to the second conveying blade on its downstream side in the second direction and which is composed of a conveying blade for conveying the developer in the direction opposite to the second conveying blade. The discharging blade is formed adjacent to the regulating portion on its downstream side in the second direction and conveys the developer in the same direction as the second conveying blade to discharge the developer through the developer discharge portion. The disk is formed, between the regulating portion and the second conveying blade, perpendicularly to the rotary shaft. The communication portion is composed of a first communication portion which, at the downstream side in the first direction, passes the developer from the first conveying chamber to the second conveying chamber, and a second communication portion which, at the downstream side in the second direction, passes the developer from the second conveying chamber to the first conveying chamber. The developer container includes a second partition wall which is arranged adjacent to the regulating portion on the downstream side of the second communication portion in the second direction to partition between the first conveying chamber and the regulating portion and a shield portion which is connected to the first and second partition walls so as to bridge between them to shield a top part of the second communication portion. A gap is formed between a top end part of the shield portion and the inner surface of the developer container.

This and other objects of the present disclosure, and the specific benefits obtained according to the present disclosure, will become apparent from the description of embodiments which follows.

DETAILED DESCRIPTION

Figure 1:
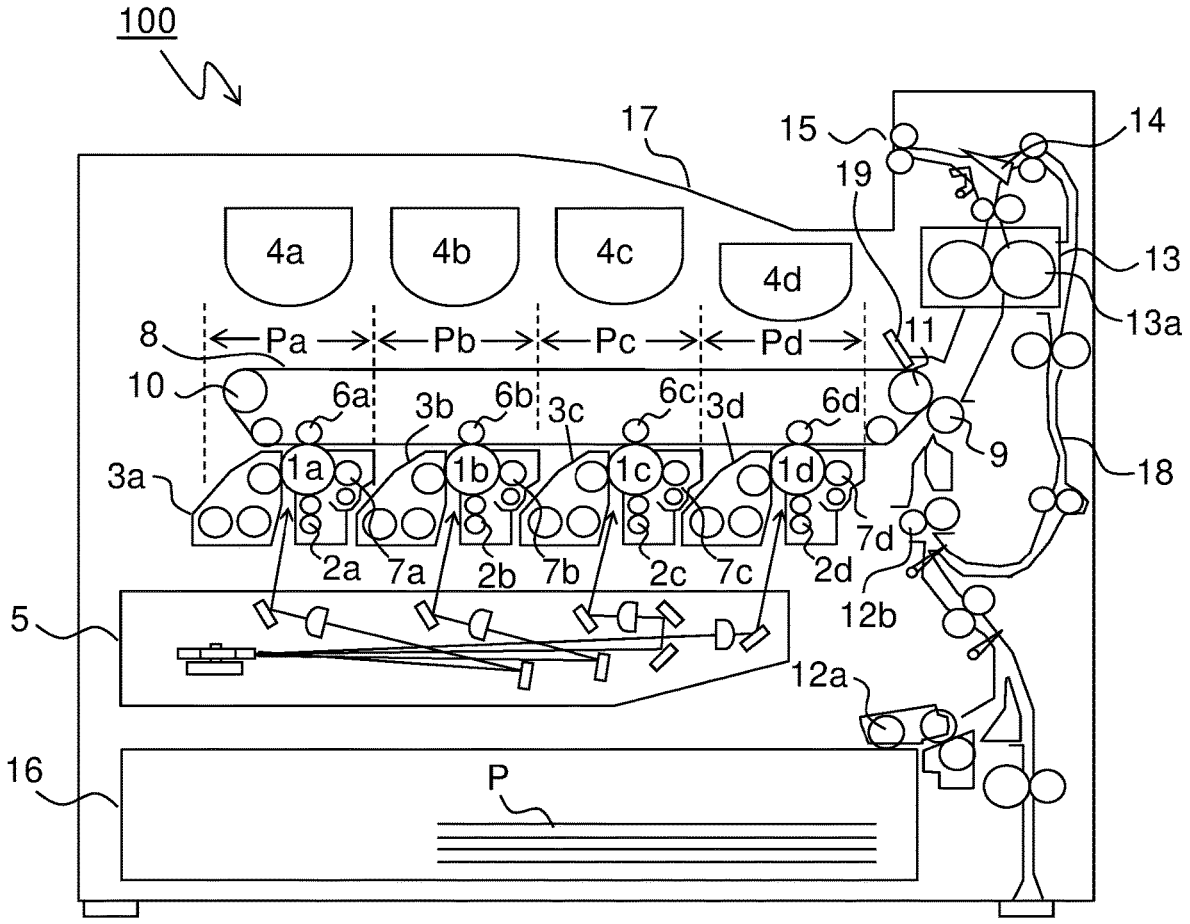
FIG. 1 is a schematic sectional view of an image forming apparatus mounted with a developing device according to the present disclosure.

Hereinafter, with reference to the accompanying drawings, embodiments of the present disclosure will be described. FIG. 1 is a sectional view showing an internal structure of an image forming apparatus 100 mounted with developing devices 3*a* to 3*d* according to the present disclosure. In the image forming apparatus 100 (here, a color printer), four image forming portions Pa, Pb, Pc and Pd are arranged in this order from upstream in the conveying direction (from the left side in FIG. 1). These image forming portions Pa to Pd are provided so as to correspond to images of four different colors (cyan, magenta, yellow, and black) and sequentially form images of cyan, magenta, yellow, and black through the processes of electrostatic charging, exposure, developing, and transfer.

In these image forming portions Pa to Pd, photosensitive drums (image carriers) 1*a*, 1*b*, 1*c*, and 1*d* are respectively arranged which carry visible images (toner images) of the different colors. Further, an intermediate transfer belt 8 which rotates, by the action of a driving mean (unillustrated), counter-clockwise in FIG. 1 is provided adjacent to the image forming portions Pa to Pd. The toner images formed on the photosensitive drums 1*a* to 1*d* are primarily transferred sequentially, while being superimposed on each other, to the intermediate transfer belt 8 that moves while keeping contact with the photosensitive drums 1*a* to 1*d*. Then, the toner images primarily transferred to the intermediate transfer belt 8 are secondarily transferred by a secondary transfer roller 9 to transfer paper P, which is one example of a recording medium. The transfer paper P on which the toner images have been secondarily transferred is, after having the toner images fixed on it in a fixing portion 13, discharged out of the main body of the image forming apparatus 100. An image forming process is performed with respect to the photosensitive drums 1*a* to 1*d* while they are rotated clockwise in FIG. 1.

The transfer paper P to which the toner image is secondarily transferred is stored in a sheet feeding cassette 16 arranged in a lower part of the main body of the image forming apparatus 100, and is conveyed via a sheet feeding roller 12*a* and a registration roller pair 12*b* to a nip portion between the secondary transfer roller 9 and a driving roller 11 of the intermediate transfer belt 8. Used as the intermediate transfer belt 8 is a sheet of dielectric resin, and typically is a belt without seams (seamless belt). On the downstream side of the secondary transfer roller 9, a blade-form belt cleaner 19 is arranged for removing toner and the like left on the surface of the intermediate transfer belt 8.

Next, the image forming portions Pa to Pd will be described. Around and below the photosensitive drums 1*a* to 1*d* that are rotatably arranged, there are provided charging devices 2*a*, 2*b*, 2*c*, and 2*d* which electrostatically charge the photosensitive drums 1*a* to 1*d* respectively, an exposure device 5 which exposes the photosensitive drums 1*a* to 1*d* to light carrying image information, developing devices 3*a*, 3*b*, 3*c*, and 3*d* which form toner images on the photosensitive drums 1*a* to 1*d* respectively, and cleaning devices 7*a*, 7*b*, 7*c*, and 7*d* which remove developer (toner) and the like left on the photosensitive drums 1*a* to 1*d* respectively.

When image data is input from a host device such as a personal computer, first, the surfaces of the photosensitive drums 1*a* to 1*d* are electrostatically charged uniformly by the charging devices 2*a* to 2*d*. Next, the exposure device 5 irradiates the photosensitive drums 1*a* to 1*d* with light based on the image data to form on them electrostatic latent images reflecting the image data. The developing devices 3*a* to 3*d* are loaded with predetermined amounts of two-component developer containing cyan, magenta, yellow, and black toner respectively. When, through formation of toner images, which will be described later, the proportion of toner in the two-component developer stored in the developing devices 3*a* to 3*d* falls below a determined value, developer containing toner and carrier is supplied from containers 4*a* to 4*d* to the developing devices 3*a* to 3*d* respectively. The toner in the developer is fed from the developing devices 3*a* to 3*d* to the photosensitive drums 1*a* to 1*d*, and electrostatically attaches to them to form toner images based on the electrostatic latent images formed through exposure to light from the exposure device 5.

Then, by primary transfer rollers 6*a* to 6*d*, electric fields with a predetermined transfer voltage are applied between the primary transfer rollers 6*a* to 6*d* and the photosensitive drums 1*a* to 1*d*, and the cyan, magenta, yellow, and black toner images on the photosensitive drums 1*a* to 1*d* are primarily transferred to the intermediate transfer belt 8. These images in four colors are formed with a predetermined positional relationship with each other that is prescribed for formation of a predetermined full-color image. Then, in preparation for the subsequent formation of new electrostatic latent images, toner and the like left on the surface of the photosensitive drums 1*a* to 1*d* after the primary transfer are removed by the cleaning devices 7*a* to 7*d*.

The intermediate transfer belt 8 is stretched around a driven roller 10 on the upstream side and the driving roller 11 on the downstream side. As the driving roller 11 is driven to rotate by a belt driving motor (unillustrated), the intermediate transfer belt 8 starts to rotate counter-clockwise, and the transfer paper P is conveyed from the registration roller pair 12*b* to a nip portion (secondary transfer nip portion) between the driving roller 11 and the secondary transfer roller 9 arranged adjacent to it with predetermined timing. The full-color image on the intermediate transfer belt 8 is thus secondarily transferred to the transfer paper P. The transfer paper P on which the toner images have been secondarily transferred is conveyed to the fixing portion 13.

The transfer paper P conveyed to the fixing portion 13 is heated and pressed by a fixing roller pair 13*a*, and thereby the toner images are fixed on the surface of the transfer paper P to form a predetermined full-color image. The transfer paper P on which the full-color image has been formed has its conveying direction switched by a branch portion 14 which is branched into a plurality of directions, and is then directly (or after being directed to a duplex printing conveying passage 18 to have images formed on both its faces) discharged to a discharge tray 17 by a discharge roller pair 15.

Figure 2:
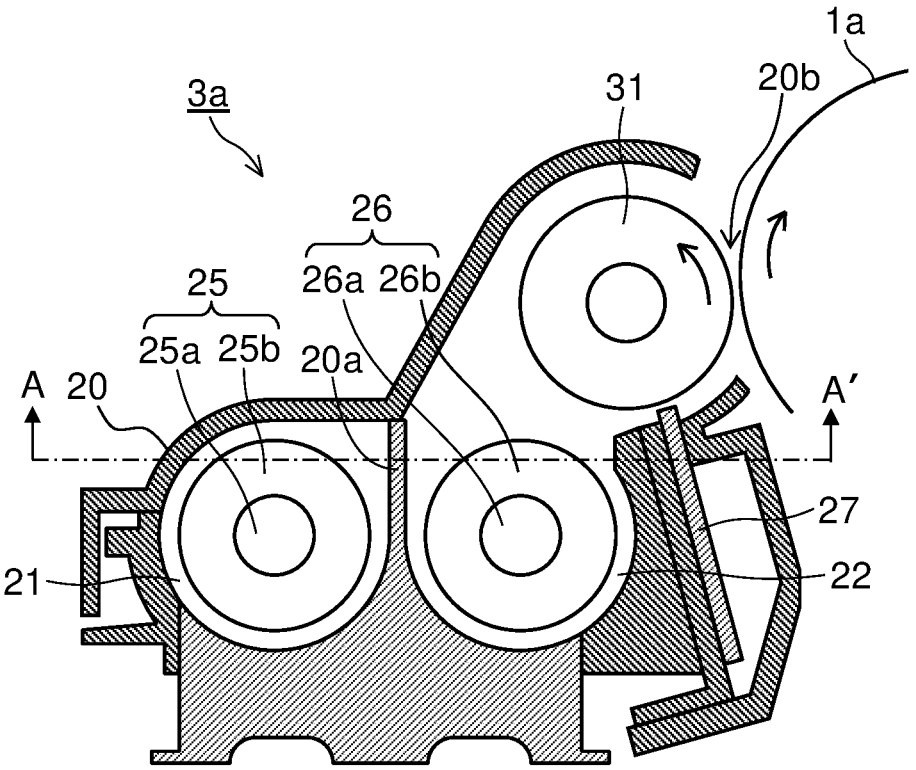
FIG. 2 is a side sectional view of a developing device according to a first embodiment of the present disclosure.

FIG. 2 is a side sectional view of a developing device 3*a* according to a first embodiment of the present disclosure incorporated in the image forming apparatus 100. The following description deals with, as an example, the developing device 3*a* arranged in the image forming portion Pa in FIG. 1. The developing devices 3*b* to 3*d* arranged in the image forming portions Pb to Pd have a structure basically similar to that of the developing device 3*a*, and thus no overlapping description will be repeated.

As shown in FIG. 2, the developing device 3*a* includes a developer container 20 that stores two-component developer (hereinafter also referred to simply as developer) containing magnetic carrier and toner. The developer container 20 is partitioned into a stirring/conveying chamber 21 and a feeding/conveying chamber 22 by a first partition wall 20*a*. In the stirring/conveying chamber 21 and the feeding/conveying chamber 22, there are respectively rotatably arranged a stirring/conveying screw 25 and a feeding/conveying screw 26 which mix the toner and the carrier fed from the container 4*a* (see FIG. 1) with the developer in the developer container 20 and which stir the mixture and thereby electrostatically charge the toner.

The stirring/conveying screw 25 arranged in the stirring/conveying chamber 21 includes a rotary shaft 25*a* and a first conveying blade 25*b* which is provided integrally with the rotary shaft 25*a* and which is formed in a helical shape with a predetermined pitch in the axial direction of the rotary shaft 25*a*. The rotary shaft 25*a* is rotatably pivoted on the developer container 20. The stirring/conveying screw 25 rotates to convey, while stirring, the developer inside the stirring/conveying chamber 21 in a predetermined direction (to one side of the developing roller 31 in its axial direction).

The feeding/conveying screw 26 arranged in the feeding/conveying chamber 22 includes a rotary shaft 26*a* and a second conveying blade 26*b* which is provided integrally with the rotary shaft 26*a* and which is formed in a helical shape with a blade pointing in the same direction as (wound in the same direction as) the first conveying blade 25*b*. The rotary shaft 26*a* is arranged parallel to the rotary shaft 25*a* of the stirring/conveying screw 25, and is rotatably pivoted on the developer container 20. The feeding/conveying screw 26 rotates to convey, while stirring, the developer inside the feeding/conveying chamber 22 in the direction opposite to the stirring/conveying screw 25 to supply it to the developing roller 31.

The developer is, while being stirred by the stirring/conveying screw 25 and the feeding/conveying screw 26, conveyed in the axial direction (the direction perpendicular to the plane of FIG. 2) and, via an upstream-side communication portion 20*e* and a downstream-side communication portion 20*f* (for either, see FIG. 3) formed in opposite end parts of the first partition wall 20*a*, circulates between the stirring/conveying chamber 21 and the feeding/conveying chamber 22. Thus, the stirring/conveying chamber 21, the feeding/conveying chamber 22, the upstream-side communication portion 20*e*, and the downstream-side communication portion 20*f* form a circulation passage for the developer inside the developer container 20.

The developer container 20 extends obliquely to the upper right in FIG. 2. To the upper right of the feeding/conveying screw 26 in the developer container 20, a developing roller 31 is arranged. Part of an outer circumferential face of the developing roller 31 is exposed through an opening 20*b* in the developer container 20 so as to face the photosensitive drum 1*a*. The developing roller 31 rotates counter-clockwise in FIG. 2. To the developing roller 31, a developing voltage is applied which is produced by superimposing an alternating-current voltage on a direct-current voltage.

The developing roller 31 is composed of a cylindrical developing sleeve which rotates counter-clockwise in FIG. 2 and a magnet (unillustrated) which is fixed inside the developing sleeve and which has a plurality of magnetic poles. Although a developing sleeve with a knurled surface is used here, any other developing sleeves can instead be used such as one with a number of recesses (dimples) formed on the surface or one with a blasted surface.

To the developer container 20, a regulating blade 27 is fixed along the longitudinal direction of the developing roller 31 (in the direction perpendicular to the plane of FIG. 2). A small gap is formed between a tip end portion of the regulating blade 27 and the surface of the developing roller 31.

Figure 3:
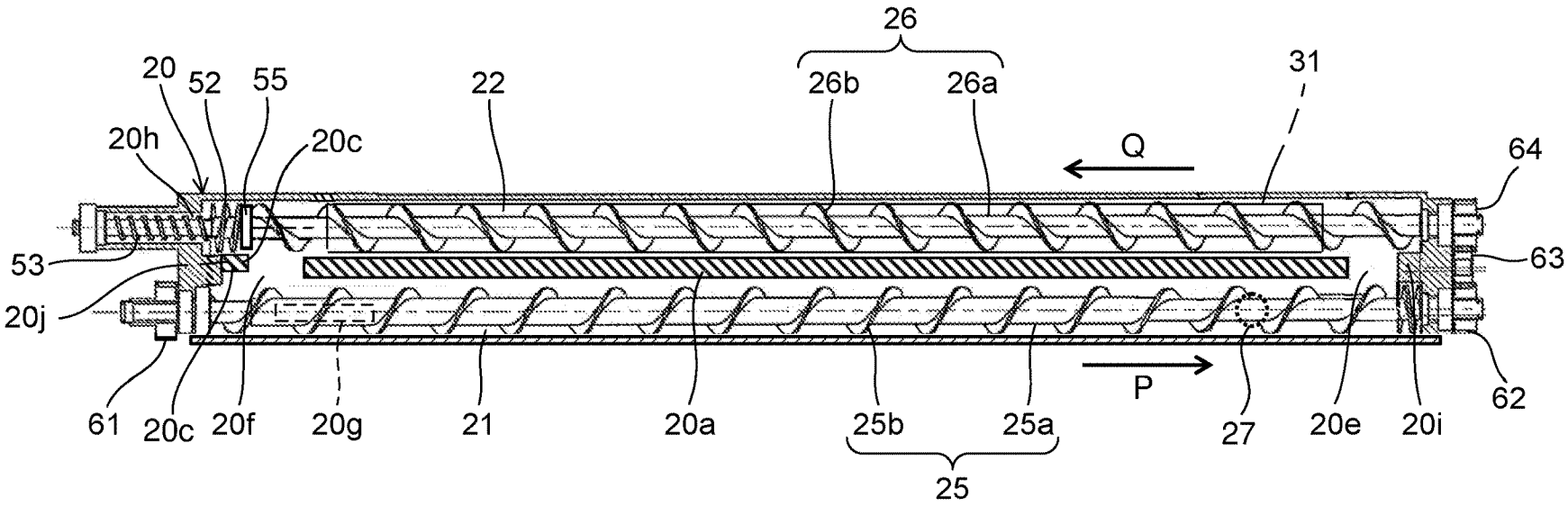
FIG. 3 is a sectional plan view showing a stirring portion in the developing device of the first embodiment.
Figure 4:
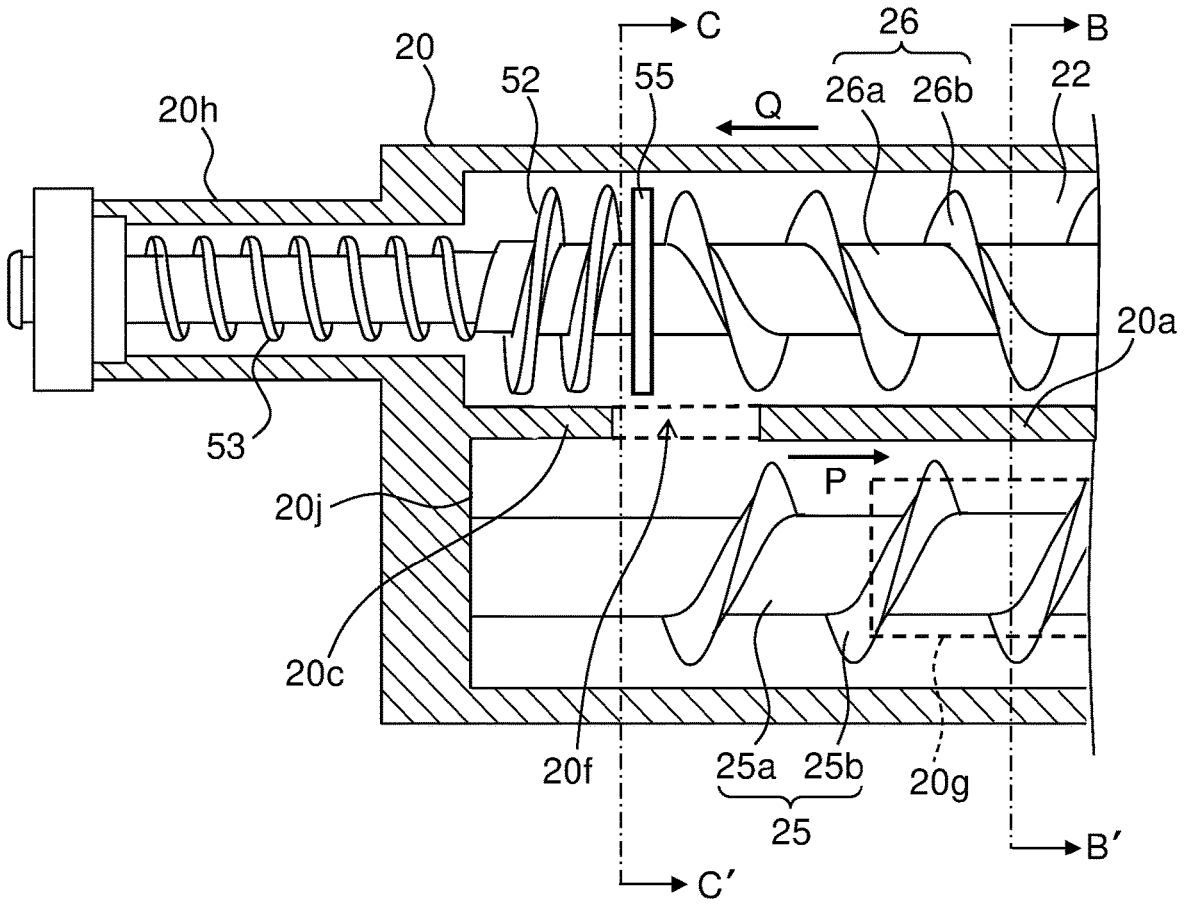
FIG. 4 is an enlarged view of and around a developer discharge portion in FIG. 3.
Figure 5:
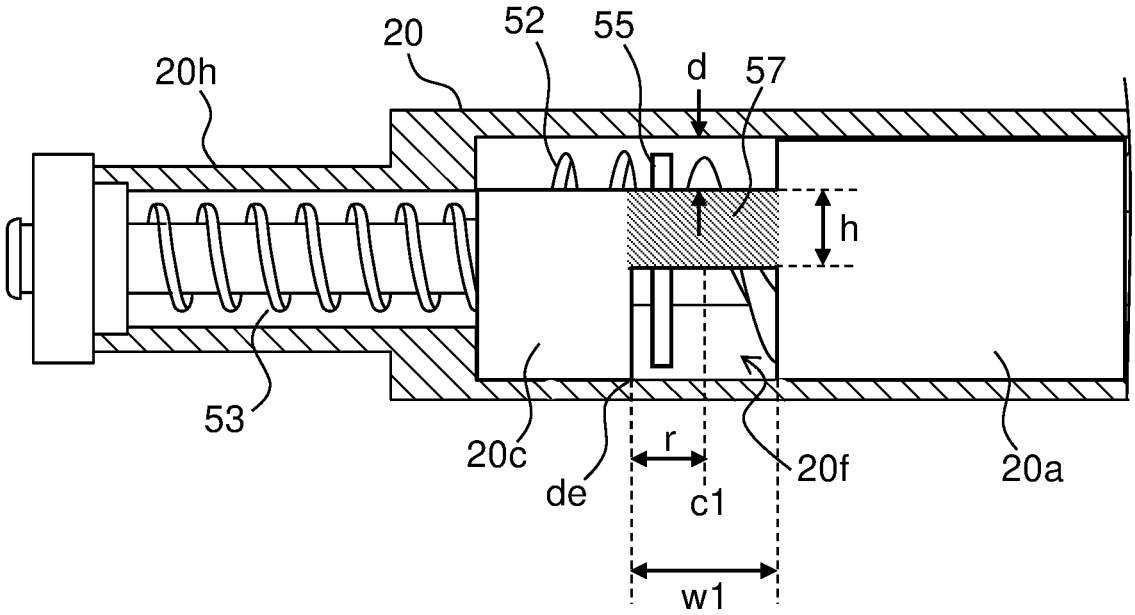
FIG. 5 is a diagram of and around a downstream-side communication portion in FIG. 4, as seen from the stirring/conveying chamber side.

Next, the structure of a stirring portion in the developing device 3*a* will be described in detail. FIG. 3 is a sectional plan view (as seen from the direction of arrows AA' in FIG. 2) showing a stirring portion of the developing device 3*a* of the first embodiment. FIG. 4 is a partly enlarged view of and around the developer discharge portion 20*h* in FIG. 3. FIG. 5 is a diagram of and around the downstream-side communication portion 20*f* in FIG. 4, as seen from the stirring/conveying chamber 21 side.

Formed in the developer container 20 are, the stirring/conveying chamber 21, the feeding/conveying chamber 22, the first partition wall 20*a*, a second partition wall 20*c*, the upstream-side communication portion 20*e*, and the downstream-side communication portion 20*f*. Additionally, there are also formed a developer supply port 20*g*, the developer discharge portion 20*h*, an upstream-side wall portion 20*i*, and a downstream-side wall portion 20*j*. It is assumed that, with respect to the stirring/conveying chamber 21, the left side in FIG. 3 is the upstream side and the right side in FIG. 3 is the downstream side, and that, with respect to the feeding/conveying chamber 22, the right side in FIG. 3 is the upstream side, and the left side in FIG. 3 is the downstream side. Accordingly, with respect to the communication portion and the wall portion, upstream side and downstream side denote those sides with respect to the feeding/conveying chamber 22.

The first partition wall 20*a* extends in the longitudinal direction of the developer container 20 and partitions it into the stirring/conveying chamber 21 and the feeding/conveying chamber 22 such that these are located side by side. The second partition wall 20*c* protrudes from the inner wall surface of the downstream-side wall portion 20*j* and is formed on an extension line from the first partition wall 20*a* so as to face the outer circumferential face of a helical blade constituting a regulating portion 52.

A right-side end part of the first partition wall 20*a* in its longitudinal direction and the inner wall portion of the upstream-side wall portion 20*i* form the upstream-side communication portion 20*e*. On the other hand, a left-side end part of the first partition wall 20*a* in its longitudinal direction and the second partition wall 20*c* form the downstream-side communication portion 20*f*.

As shown in FIG. 5, a top part of the downstream-side communication portion 20*f* is shielded by a shield portion 57 which is connected to the first and second partition walls 20*a* and 20*c* so as to bridge between them. That is, the downstream-side communication portion 20*f* is a tunnel-like opening surrounded by the first and second partition walls 20*a* and 20*c* and the shield portion 57. A gap (clearance) d is formed over the shield portion 57 between it and the inner surface of the developer container 20.

The developer supply port 20*g* is an opening for supplying new toner and carrier to the developer container 20 from the container 4*a* (see FIG. 1) provided in an upper part of the developer container 20, and is arranged on the upstream side of the stirring/conveying chamber 21 (on the left side in FIG. 3).

The developer discharge portion 20*h* discharges the developer which has become excessive in the stirring/conveying chamber 21 and the feeding/conveying chamber 22 due to the supply of the developer. The developer discharge portion 20*h* is provided on the downstream side of the feeding/conveying chamber 22 continuously in the longitudinal direction of the feeding/conveying chamber 22.

The stirring/conveying screw 25 extends up to the opposite ends of the stirring/conveying chamber 21 in its longitudinal direction and the first conveying blade 25*b* is provided so as to face the upstream-side and downstream-side communication portions 20*e* and 20*f*. The rotary shaft 25*a* is rotatably pivoted on the upstream-side and downstream-side wall portions 20*i* and 20*j* of the developer container 20.

The feeding/conveying screw 26 is longer than the developing roller 31 in its axial direction, and is provided so as to extend up to a position where it faces the upstream-side communication portion 20*e*. The rotary shaft 26*a* is arranged parallel to the rotary shaft 25*a* of the stirring/conveying screw 25, and is rotatably pivoted on the upstream-side wall portion 20*i* and the developer discharge portion 20*h* of the developer container 20. To the rotary shaft 26*a* of the feeding/conveying screw 26, in addition to the second conveying blade 26*b*, the regulating portion 52 and a discharging blade 53 are integrally arranged.

The regulating portion 52 holds back the developer conveyed to the downstream side in the feeding/conveying chamber 22 and conveys the developer exceeding a predetermined amount to the developer discharge portion 20*h*. The regulating portion 52 is composed of a helical blade provided on the rotary shaft 26*a*. This helical blade is formed in a helical shape with a blade pointing in the direction opposite to (wound reversely to) the second conveying blade 26*b*, has a substantially same outer diameter as the second conveying blade 26*b*, and has a pitch smaller than that of the second conveying blade 26*b*. The regulating portion 52 forms a predetermined clearance between the inner wall portion of the developer container 20. Excessive developer moves to the developer discharge portion 20*h* through this clearance.

On the rotary shaft 26*a* in the developer discharge portion 20*h*, the discharging blade 53 is provided. The discharging blade 53 is composed of a helical blade pointing in the same direction as the second conveying blade 26*b* with a smaller pitch and a smaller blade outer circumference compared to the second conveying blade 26*b*. As the rotary shaft 26*a* rotates, the discharging blade 53 rotates together. The excessive developer which has moved over the regulating portion 52 and has been conveyed into the developer discharge portion 20*h* is conveyed to the left side in FIG. 4 to be discharged to outside the developer container 20 through an unillustrated developer discharge port.

On the outer wall of the developer container 20, gears 61 to 64 are arranged. The gears 61 and 62 are fixed to the rotary shaft 25*a*, and the gear 64 is fixed to the rotary shaft 26*a*. The gear 63 is rotatably supported on the developer container 20 and meshes with the gears 62 and 64.

As a developer driving motor (unillustrated) rotates the gear 61, the stirring/conveying screw 25 rotates. The developer in the stirring/conveying chamber 21 is conveyed in the main conveying direction (first direction, arrow P direction) by the first conveying blade 25*b*, and is then conveyed into the feeding/conveying chamber 22 via the upstream-side communication portion 20*e*. As the feeding/conveying screw 26 rotates via the gears 62 to 64, the developer inside the feeding/conveying chamber 22 is conveyed by the second conveying blade 26*b* in the main conveying direction (second direction, arrow Q direction). During developing during which no new developer is supplied, the developer is, while greatly changing its height, conveyed into the feeding/conveying chamber 22 from the stirring/conveying chamber 21 via the upstream-side communication portion 20*e*. Then, without moving over the regulating portion 52, the developer is conveyed via the downstream-side communication portion 20*f* to the stirring/conveying chamber 21.

In this way, developer is stirred while circulating from the stirring/conveying chamber 21 to the upstream-side communication portion 20*e*, then to the feeding/conveying chamber 22, and then to the downstream-side communication portion 20*f*. The stirred developer is fed to the developing roller 31.

Next, a description will be given of a case where developer is supplied through the developer supply port 20*g*. As toner is consumed in development, the developer containing toner and carrier is supplied from the container 4*a* via the developer supply port 20*g* to the stirring/conveying chamber 21.

The supplied developer is, as during development, conveyed inside the stirring/conveying chamber 21 in the main conveying direction (arrow P direction) by the stirring/conveying screw 25, and is then conveyed into the feeding/conveying chamber 22 via the upstream-side communication portion 20*e*. Then, by the feeding/conveying screw 26, the developer inside the feeding/conveying chamber 22 is conveyed in the main conveying direction (arrow Q direction). When the regulating portion 52 rotates as the rotary shaft 26*a* rotates, a conveying force in the direction (reverse conveying direction) opposite to the main conveying direction is applied to the developer by the regulating portion 52.

The developer is held back by the regulating portion 52 to bulk up, and the excessive developer (the same amount as the developer supplied from the developer supply port 20*g*) moves over the regulating portion 52 and is discharged to outside the developer container 20 through the developer discharge portion 20*h*.

As shown in FIG. 4, in the feeding/conveying screw 26, there is arranged a disk 55 between the second conveying blade 26*b* and the regulating portion 52. The disk 55 is, together with the second conveying blade 26*b*, the regulating portion 52, and the discharging blade 53, molded of synthetic resin integrally with the rotary shaft 26*a*.

The developer which is conveyed in the main conveying direction (arrow Q direction) by the second conveying blade 26*b* is held back by the disk 55, and this momentarily weakens the conveying force of the developer. Then, a conveying force in the opposite direction is applied to the developer by the regulating portion 52, and the developer is pushed back in the direction opposite to the main conveying direction. That is, the disk 55 plays a role of reducing the conveying force (pressure) acting from the feeding/conveying chamber 22 to the regulating portion 52. As a result, it is possible to prevent waving (fluctuation) at the surface of the developer which is moving to the regulating portion 52 and the downstream-side communication portion 20*f*, and thus, regardless of the conveying speed of the developer, a nearly constant amount of developer can be retained around the regulating portion 52.

Then, when the developer is supplied from the developer supply port 20*g* to increase the height of the developer in the developer container 20, the developer stagnating on the upstream side of the regulating portion 52 moves over the disk 55 and the regulating portion 52 to the discharging blade 53 (developer discharge portion 20*h*), and excessive developer is discharged from the developer discharge portion 20*h*. When the developer ceases to be discharged from the developer discharge portion 20*h*, the height of the developer in the developer container 20 is stabilized. The volume of the developer when its height is stabilized is referred to as a stable volume.

In the image forming apparatus 100 according to the present disclosure, the processing speed can be switched between two speeds depending on the thickness and the kind of transfer paper P to be conveyed and the type of an output image. That is, when the transfer paper P is regular paper or when a text-based document is output, image forming processing is performed at a regular operation speed (hereinafter, referred to as a full speed mode) and, when the transfer paper P is thick paper or when a photo image is output, image forming processing is performed in a speed (hereinafter, referred to as a slowdown mode) slower than the regular speed. It is thus possible, when thick paper is used as the transfer paper P or when a photo image is output, to secure a sufficient fixing time and improve image quality.

Switching between the full speed mode and the slowdown mode as described above results in changing the rotation speed of the stirring/conveying screw 25 and the feeding/conveying screw 26; thus the conveying speed of the developer inside the developer container 20 changes sharply. This results in an uneven distribution of developer inside the developer container 20 and thus a change in the height (surface level) of the developer. This changes also the amount of developer discharged from the developer discharge portion 20*h* and hence the amount of developer inside the developer container 20.

Specifically, as the conveying speed of the developer (the rotation speed of the stirring/conveying screw 25 and the feeding/conveying screw 26) increases, even when the weight of the developer inside the developer container 20 is constant, the height of the developer increases. For example, when the conveying speed of the developer is increased, the developer may, before reaching the downstream side of the regulating portion 52, be passed from the feeding/conveying chamber 22 via the downstream-side communication portion 20*f* to the stirring/conveying chamber 21. As a result, less developer reaches the regulating portion 52, and this makes it difficult to discharge developer through the developer discharge portion 20*h*. In this embodiment, the amount of developer discharged is adjusted by adjusting the height of the shield portion 57 that is arranged over the downstream-side communication portion 20*f*.

Figure 6:
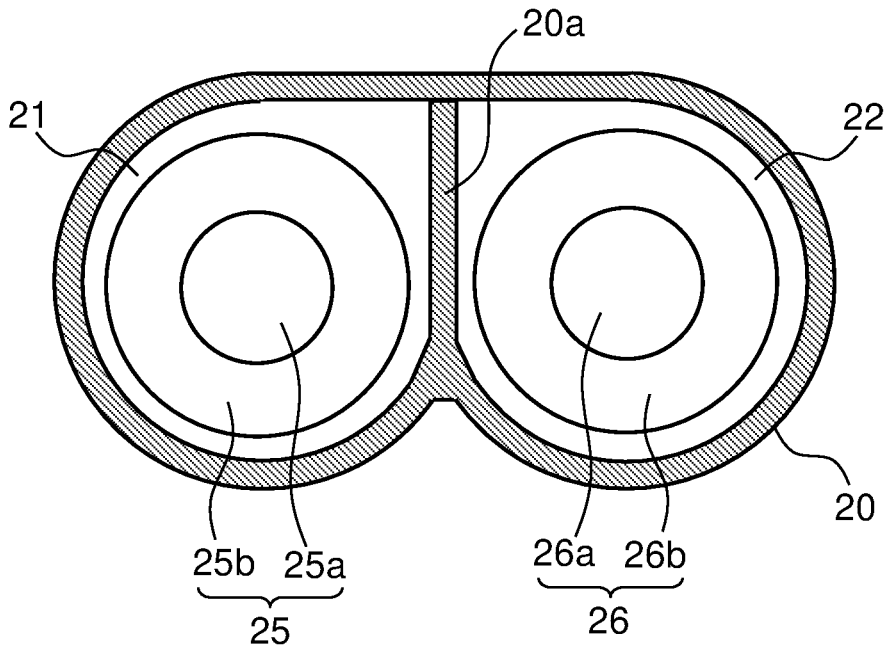
FIG. 6 is a longitudinal sectional view of the stirring/conveying chamber and a feeding/conveying chamber including a first partition wall in the developing device of the first embodiment.

FIG. 6 is a longitudinal sectional view (as seen from the direction of arrows BB' in FIG. 4) of the stirring/conveying chamber 21 and the feeding/conveying chamber 22 including the first partition wall 20*a* in the developing device 3*a* of the first embodiment. As shown in FIG. 6, the first partition wall 20*a* extends up to the top faces of the stirring/conveying chamber 21 and the feeding/conveying chamber 22 so as to completely partition between the stirring/conveying chamber 21 and the feeding/conveying chamber 22 along the longitudinal direction (the direction perpendicular to the plane of FIG. 6).

Figure 7:
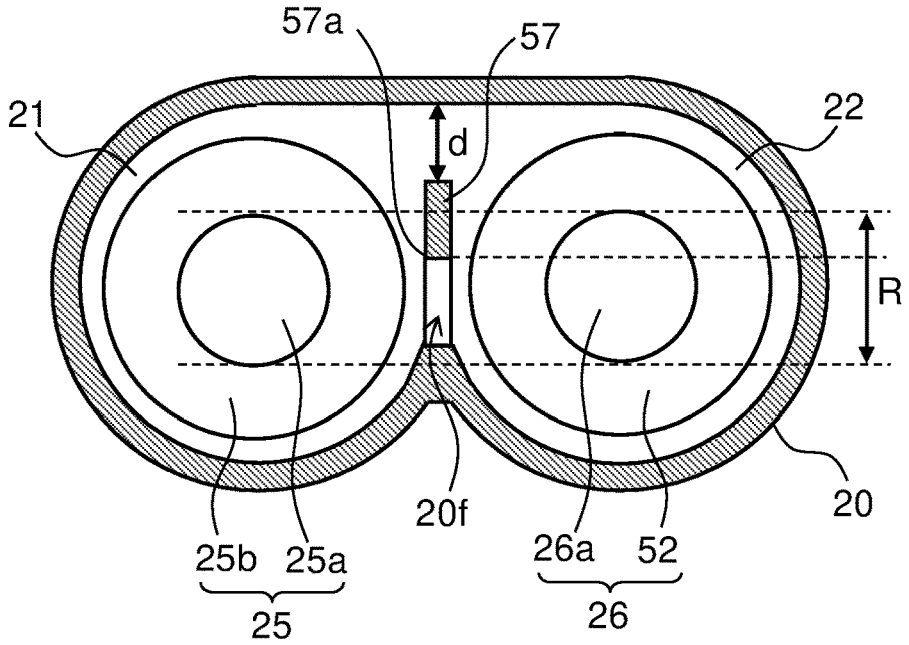
FIG. 7 is a longitudinal sectional view of the stirring/conveying chamber and the feeding/conveying chamber including the downstream-side communication portion in the developing device of the first embodiment.

FIG. 7 is a longitudinal sectional view (as seen from the direction of arrows CC' in FIG. 4) of the stirring/conveying chamber 21 and the feeding/conveying chamber 22 including the downstream-side communication portion 20*f* in the developing device 3*a* of the first embodiment. As shown in FIG. 7, a gap d is formed between an upper end part of the shield portion 57 and the inner surface of the developer container 20 (the stirring/conveying chamber 21 and the feeding/conveying chamber 22).

When the conveying speed of the developer is high, more developer is passed from the feeding/conveying chamber 22 to the stirring/conveying chamber 21, and less developer moves over the gap between the feeding/conveying chamber 22 and the disk 55 to reach the regulating portion 52. Thus, movement of the developer from the feeding/conveying chamber 22 to the stirring/conveying chamber 21 is restricted by adjusting the height (shielding width) of the shield portion 57.

When the conveying speed of the developer is high, the developer that passes through the downstream-side communication portion 20*f* as well as the developer that passes from the feeding/conveying chamber 22 over the shield portion 57 through the gap d above move to the stirring/conveying chamber 21. As a result, movement of the developer to the stirring/conveying chamber 21 is restricted compared to a structure without the shield portion 57, and thus more developer moves to the regulating portion 52. On the other hand, when the conveying speed of the developer is low, only the developer that passes from the feeding/conveying chamber 22 and through the downstream-side communication portion 20*f* moves to the stirring/conveying chamber 21. This helps keep constant the amount of developer that reaches the regulating portion 52 regardless of the conveying speed of the developer, and helps suppress variation in the amount of developer discharged and stabilize the height of the developer in the developer container 20.

To adjust the amount of developer that is passed from the feeding/conveying chamber 22 to the stirring/conveying chamber 21, it is important how to adjust the gap d, the height h of the shield portion 57, and an opening width w1 (see FIG. 5). When the gap d is too small, the developer cannot move over the shield portion 57 when the conveying speed of the developer is higher, and this results in an increase in the height of the developer in the feeding/conveying chamber 22. Although it is preferable that the gap d be minimized to make the developing device 3*a* compact, the gap d needs to be set such that, even when the conveying speed is high, the developer can move over the shield portion 57.

It is preferable that a lower end part 57*a* of the shield portion 57 be at a position overlapping a region (region R in FIG. 7) between upper and lower end parts of the rotary shaft 25*a* of the stirring/conveying screw 25 and the rotary shaft 26*a* of the feeding/conveying screw 26. That is, the height h of the shield portion 57 is determined based on the positions of the gap d and the lower end part 57*a*. The opening width w1 is determined in accordance with the amount of developer stored in the developer container 20 and the specifications of developer.

Figure 8:
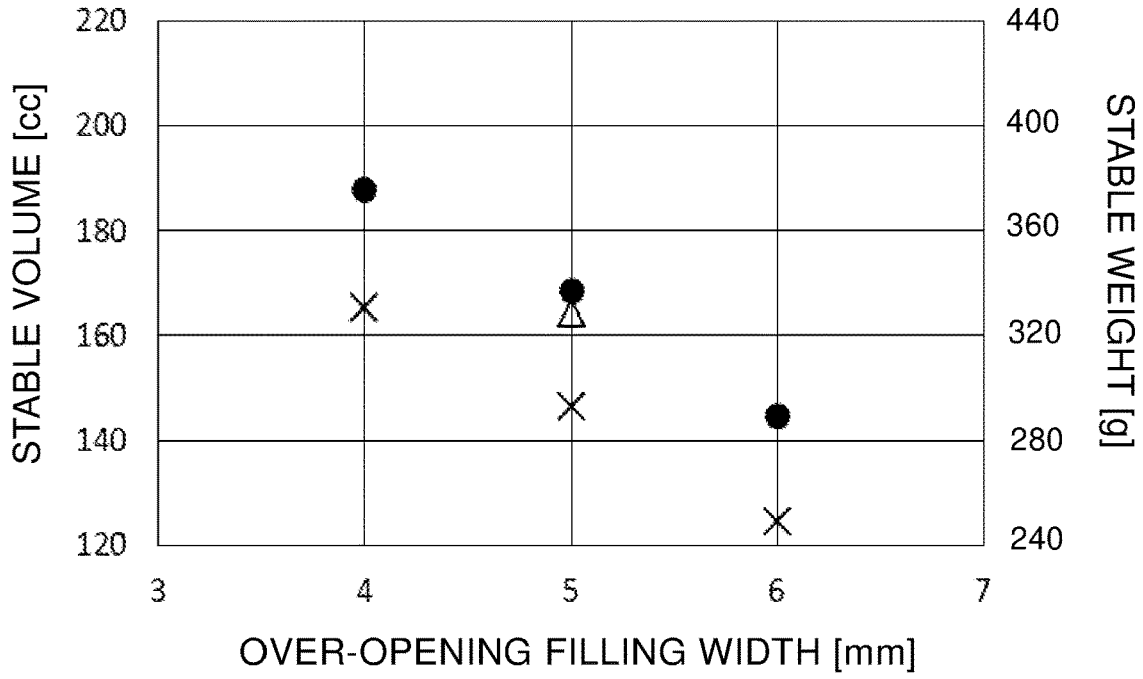
FIG. 8 is a graph showing the relationship of the height of a shield portion with the stable volume of developer in the developing device of the first embodiment.

FIG. 8 is a graph showing the relationship of the height h (over-opening filling width) of the shield portion 57 with the stable volume and stable weight of the developer. FIG. 8 shows how the stable volume and stable weight of developer changed when, with the processing speed set at 70 sheets per minute and the opening width w1 of the downstream-side communication portion 20*f* set at 15 mm, 20 mm, and 25 mm, the over-opening filling width was varied among 4 mm, 5 mm, and 6 mm.

As shown in FIG. 8, in any of the cases where the opening width w1 was 15 mm (the series of data indicated by crosses), 20 mm (the series of data indicated by hollow triangles), and 25 mm (the series of data indicated by solid circles), the larger the over-opening filling width, the smaller the stable volume and stable weight of the developer. This is because the increased height h of the shield portion 57 restricts the movement of developer from the feeding/conveying chamber 22 to the stirring/conveying chamber 21, resulting in a larger amount of developer moving toward the regulating portion 52 and consequently a larger amount of developer being discharged.

Figure 9:
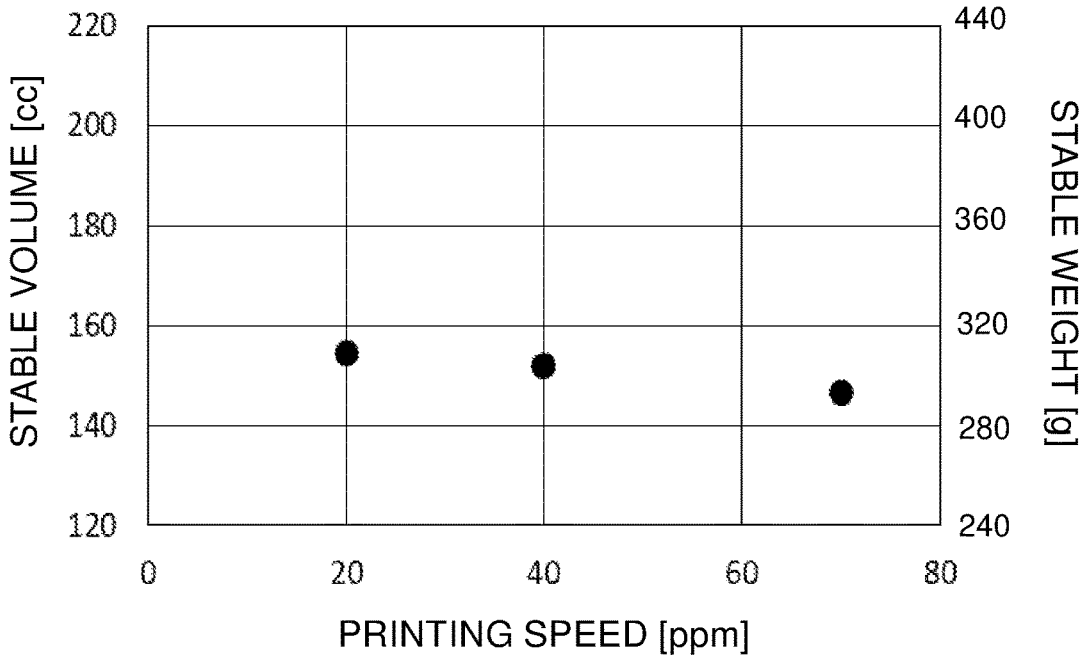
FIG. 9 is a graph showing the relationship of the rotation speed of the stirring/conveying screw and the feeding/conveying screw with the stable volume of developer in the developing device of the first embodiment.

FIG. 9 is a graph showing the relationship of the rotation speed of the stirring/conveying screw 25 and the feeding/conveying screw 26 with the stable volume and stable weight of developer. FIG. 9 shows how the stable volume and stable weight of developer changed when, with the opening width w1 of the downstream-side communication portion 20*f* set at 15 mm and the height h of the shield portion 57 (over-opening filling width) set at 5 mm, the rotation speed of the stirring/conveying screw 25 and the feeding/conveying screw 26 was varied among 139 rpm, 278 rpm, and 449 rpm (corresponding to the printing speeds of 20 sheets per minute, 40 sheets per minute, and 70 sheets per minute respectively).

As shown in FIG. 9, in any of the cases where the printing speed was 20 sheets per minute, 40 sheets per minute, and 70 sheets per minute, the stable volume of developer vacillated between 150 cc and 160 cc, and the stable weight of developer vacillated between 290 g and 310 g. These results confirm that, by providing the shield portion 57 over the downstream-side communication portion 20*f*, it is possible to keep the stable volume of developer constant regardless of the rotation speed of the stirring/conveying screw 25 and the feeding/conveying screw 26.

The height h of the shield portion 57 may be, so long as the gap d can be secured above, up to as high as the top face (an upper end part of the first partition wall 20*a*) of a developer circulating portion in the developer container 20. Or, the height can be adjusted as necessary depending on the developer used and the process line speed within a range between above the rotary shafts 25*a* and 26*a* of the stirring/conveying screw 25 and the feeding/conveying screw 26 and below the upper end parts of the conveying blades 25*b* and 26*b*.

Furthermore, as shown in FIG. 5, the disk 55 provided on the feeding/conveying screw 26 is arranged so that its position in the axial direction falls within a region r between the middle c1 of the downstream-side communication portion 20*f* in its width direction and a downstream-side end part de of the downstream-side communication portion 20*f* with respect to the main conveying direction (arrow Q direction) of the developer in the feeding/conveying chamber 22.

When the disk 55 is arranged on the upstream side (right side of FIG. 5) of the middle c1 of the downstream-side communication portion 20*f* in its width direction, the flow of developer from the feeding/conveying screw 26 to the stirring/conveying screw 25 is weaker, leading to an increase in the amount of developer discharged from the developer discharge portion 20*h*. As a result, the amount of developer in the developer container 20 tends to decrease. On the other hand, if the disk 55 is arranged on the downstream side (left side of FIG. 5) of the downstream-side end part de of the downstream-side communication portion 20*f*, when the rotation speed of the stirring/conveying screw 25 and the feeding/conveying screw 26 is high, the flow of developer from the feeding/conveying screw 26 to the stirring/conveying screw 25 is stronger, leading to a decrease in the amount of developer discharged from the developer discharge portion 20*h*. This results in a larger variation in the height of developer due to a difference in the rotation speed of the stirring/conveying screw 25 and the feeding/conveying screw 26 is large.

Thus, by arranging the position of the disk 55 in the axial direction within the region r as in this embodiment, it is possible, regardless of the rotation speed of the stirring/conveying screw 25 and the feeding/conveying screw 26, to maintain the stable volume of developer in an even more stable manner.

When the outer diameter of the disk 55 is smaller than the shaft diameter of the rotary shaft 26*a*, no disk 55 is formed in the first place, and no blocking effect of a disk 55 can be expected. When the outer diameter of the disk 55 is larger than that of the second conveying blade 26*b*, the disk 55 may make contact with the inner wall surface of the feeding/conveying chamber 22. Thus, the outer diameter of the disk 55 is larger than the shaft diameter of the rotary shaft 26*a* of the feeding/conveying screw 26 but equal to or smaller than the outer diameter of the second conveying blade 26*b*.

Figure 10:
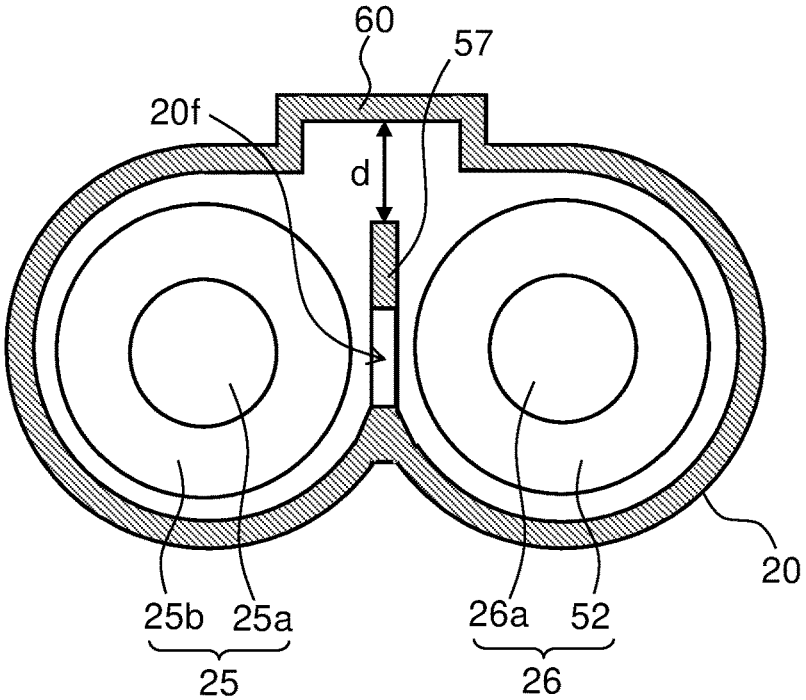
FIG. 10 is a longitudinal sectional view of the stirring/conveying chamber and the feeding/conveying chamber including the downstream-side communication portion in a modified example of the developing device of the first embodiment where a stepped part is provided over the shield portion.

FIG. 10 is a cross-sectional view of and around the stirring/conveying chamber 21 and the feeding/conveying chamber 22 including the downstream-side communication portion 20*f* in a modified example of the developing device 3*a* of the first embodiment where a stepped part 60 is provided over the shield portion 57. As shown in FIG. 10, by forming the stepped part 60 that is recessed upward in the inner surface of the developer container 20, it is possible, while keeping the shield portion 57 at a predetermined height, to secure the gap d large enough for the developer to move over the shield portion 57. The height and the width of the stepped part 60 can be set in accordance with the flowability and the conveying speed of the developer.

Figure 11:
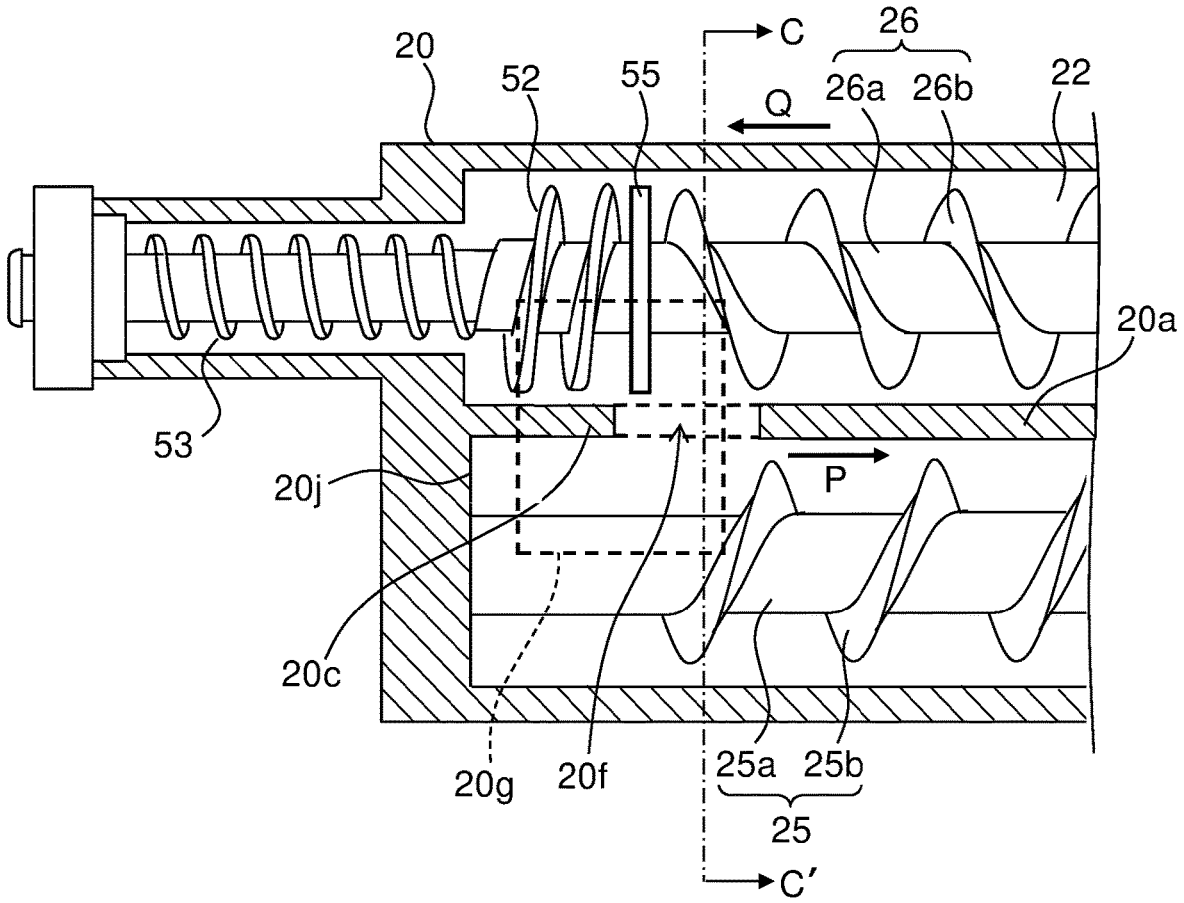
FIG. 11 is a sectional plan view of and around the developer discharge portion in a developing device according to a second embodiment of the present disclosure.
Figure 12:
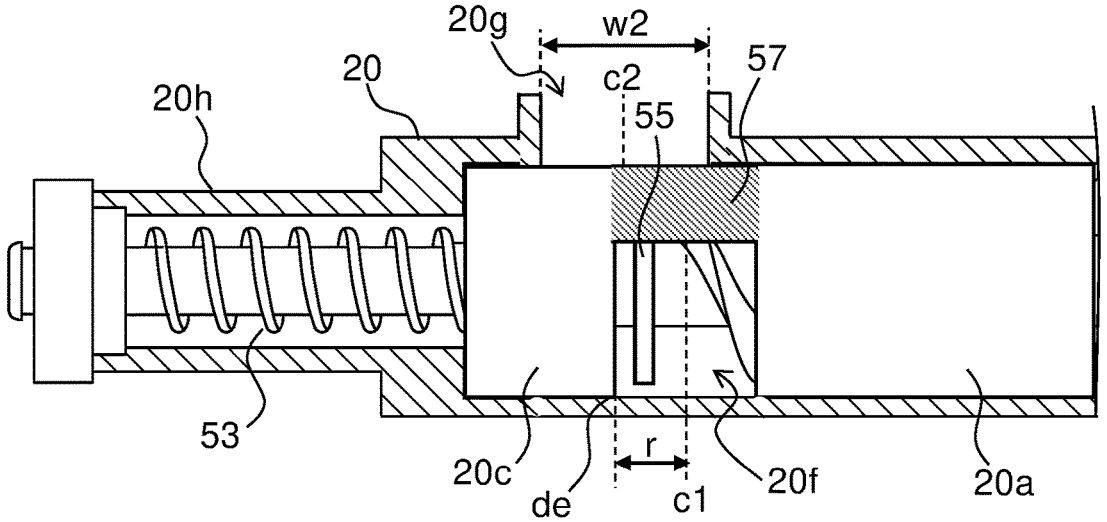
FIG. 12 is a diagram of and around the downstream-side communication portion in FIG. 11, as seen from the stirring/conveying chamber side.
Figure 13:
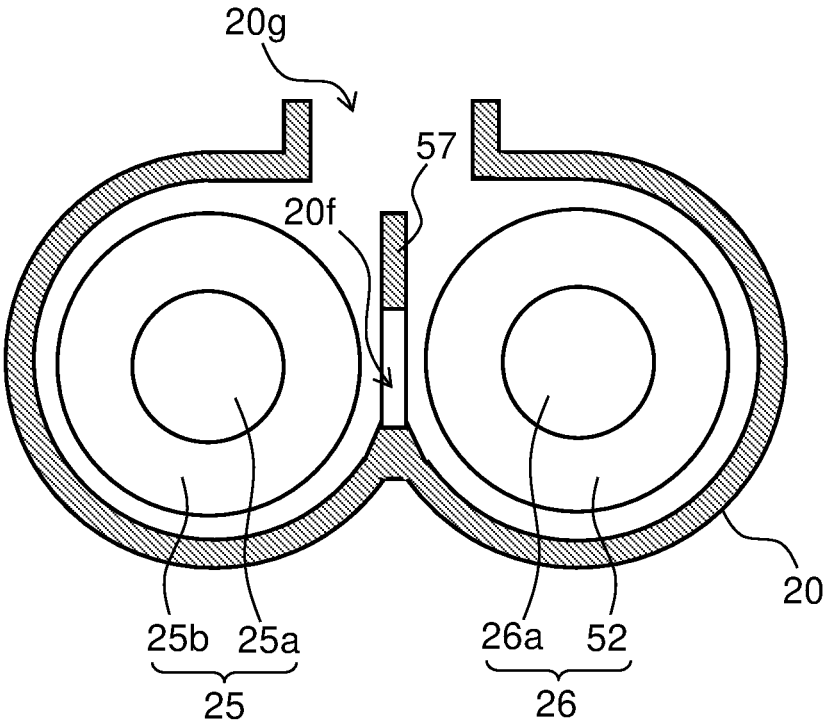
FIG. 13 is a longitudinal sectional view of the stirring/conveying chamber and the feeding/conveying chamber including the downstream-side communication portion in the developing device of the second embodiment.

FIG. 11 is an enlarged sectional view of and around the developer discharge portion 20*h* in a developing device 3*a* according to a second embodiment of the present disclosure. FIG. 12 is a diagram of and around the downstream-side communication portion 20*f* in FIG. 11 as seen from the stirring/conveying chamber 21 side. FIG. 13 is a longitudinal sectional view (as seen from the direction of arrows CC' in FIG. 11) of the stirring/conveying chamber 21 and the feeding/conveying chamber 22 including the downstream-side communication portion 20*f* in the developing device 3*a* of the second embodiment. In this embodiment, the developer supply port 20*g* is arranged over the shield portion 57. In other respects, the structure of the developing device 3*a* is similar to that in the first embodiment.

By arranging the developer supply port 20*g* over the shield portion 57, it is possible to form a space over the shield portion 57 as shown in FIGS. 12 and 13. When the conveying speed of developer is high, the shield portion 57 restricts movement of developer from the feeding/conveying chamber 22 to the stirring/conveying chamber 21, and when the developer in the feeding/conveying chamber 22 reaches a predetermined or larger height, the developer moves from the feeding/conveying chamber 22 over the shield portion 57 to the stirring/conveying chamber 21 smoothly. This, as in the first embodiment, helps keep constant the amount of developer that reaches the regulating portion 52 regardless of the conveying speed of the developer, and helps suppress variation in the amount of developer discharged and stabilize the height of the developer in the developer container 20.

Around the shield portion 57 is where developer tends to stagnate owing to the movement of developer from the feeding/conveying chamber 22 to the stirring/conveying chamber 21 being restricted and the developer being pushed back by the regulating portion 52. With the developer supply port 20*g* arranged over the shield portion 57, the supplied developer in an agglomerated state is easily crushed. Thus, the supplied developer is mixed well with the developer circulating in the developer container 20, and this helps stabilize the amount of electric charge on the toner in the developer.

Also in this embodiment, as shown in FIG. 12, the disk 55 provided on the feeding/conveying screw 26 is arranged so that its position in the axial direction falls within the region r between the middle c1 of the downstream-side communication portion 20*f* in its width direction and the downstream-side end part de of the downstream-side communication portion 20*f* with respect to the main conveying direction (arrow Q direction) of the developer in the feeding/conveying chamber 22. This makes it possible to maintain the stable volume of developer in an even more stable manner regardless of the rotation speed of the stirring/conveying screw 25 and the feeding/conveying screw 26.

Furthermore, in this embodiment, the disk 55 is arranged so that its position in the axial direction is on the upstream side (right side of FIG. 12), with respect to the main conveying direction (arrow Q direction) of the developer in the feeding/conveying chamber 22, of the middle c2 of the opening width w2 of the developer supply port 20*g* in the axial direction of the feeding/conveying screw 26. With this structure, it is possible to drop the supplied toner through the developer supply port 20*g* to a position where the developer is blocked by the disk 55. In this way, the developer in the developer container 20 is mixed more easily with the supplied toner and this helps stabilize the amount of electrostatic charge on the toner in the developer.

The embodiments described above are in no way meant to limit the present disclosure, which thus allows for many modifications and variations within the spirit of the present disclosure. For example, also in the second embodiment where the developer supply port 20*g* is arranged over the shield portion 57, as in the modified example of the first embodiment shown in FIG. 10, the stepped part 60 may be formed around the developer supply port 20*g*.

Although the above embodiments deal with developing devices 3*a* to 3*d* provided with a developing roller 31 as shown in FIG. 2, this is not meant to be any limitation. The present disclosure is applicable to various developing devices which use two-component developer containing toner and carrier, such as those which, for example, have a magnetic roller for carrying developer and form a toner layer by moving toner alone from the magnetic roller to a developing roller 31 to develop an electrostatic latent image using the toner layer on the developing roller 31.

The present disclosure is applicable not only to tandem-type color printers like the one shown in FIG. 1 but to various types of image forming apparatuses employing a two-component development system, such as digital and analog monochrome copiers, monochrome printers, color copiers, and facsimile machines. The benefits of the present disclosure will now be described in more detail by way of practical examples.

Example 1

In an image forming apparatus 100 like the one shown in FIG. 1, how the amount of developer in the developing devices 3*a* to 3*d* changed as the conveying speed of developer was changed was studied. The tests were conducted on the image forming portion Pa of cyan including the photosensitive drum 1*a* and the developing device 3*a*.

The tests proceeded as follows. The developing device 3*a* of the first embodiment where, as shown in FIGS. 4 and 5, the shield portion 57 is provided over the downstream-side communication portion 20*f* and the gap d is formed over the shield portion 57 was taken as Practical Example 1. The developing device 3*a* of the second embodiment where, as shown in FIGS. 11 and 12, the developer supply port 20*g* was formed over the shield portion 57 was taken as Practical Example 2. The developing device 3*a* where no shield portion 57 was provided over the downstream-side communication portion 20*f* was taken as Comparative Example.

The developer containers 20 of the developing devices 3*a* of the Practical Example 1 and 2 and Comparative Example were each loaded with 175 cc of developer (with a toner concentration of 6%), and the developing devices 3*a* were each driven in a normal-temperature and normal-humidity environment (25° C., 50%), with the stirring/conveying screw 25 and the feeding/conveying screw 26 rotated at three different rotation speeds of 139 rpm, 278 rpm, and 449 rpm to stir and convey the developer. When the developer ceases to be discharged from the discharge portion 20*h*, the amount (stable weight, stable volume) of the developer in the developer container 20 was measured.

The first and second conveying blades 25*b* and 26*b* of the stirring/conveying screw 25 and the feeding/conveying screw 26 that were used in Practical Example 1 and 2 and Comparative Example were helical blades with an outer diameter of 18 mm. The height of the first partition wall 20*a* was 15 mm. The regulating portion 52 was formed of three helical blades having an outer diameter of 18 mm and wound reversely. The height of the second partition wall 20*c* was 8 mm. The discharging blade 53 was a helical blade with an outer diameter of 8 mm. The gap (clearance) between the second conveying blade 26*b* or the regulating portion 52 and the top face of the feeding/conveying chamber 22 was 1.5 mm, and the gap between the discharging blade 53 and the developer discharge portion 20*h* was 1.5 mm.

A disk 55 with a diameter of 18 mm was formed between the second conveying blade 26*b* and the regulating portion 52 of the feeding/conveying screw 26, and was arranged 2 mm upstream of (in FIG. 5, on the right side of) the downstream-side end part de of the downstream-side communication portion 20*f* in the conveying direction of developer in the feeding/conveying chamber 22.

The height h of the shield portion 57 in the developing device 3*a* of Practical Example 1 and 2 was 5 mm. In the developing device 3*a* of Practical Example 1, the gap d of 5 mm was formed over the shield portion 57. In the developing device 3*a* of Practical Example 2, a space was formed by the developer supply port 20*g* over the shield portion 57.

The amount of developer was measured as follows. The developing devices 3*a* of Practical Example 1 and 2 and Comparative Example were each mounted in a testing machine and the developer was stirred as the rotation speed of the stirring/conveying screw 25 and the feeding/conveying screw 26 (i.e., the conveying speed of the developer in the stirring/conveying chamber 21 and the feeding/conveying chamber 22) was changed, and then the developing device 3*a* was removed and its weight was measured. The amount (stable weight) of developer was calculated by subtracting from the measured weight of the developing device 3*a* the weight of the empty developing device 3*a* with the developer removed. The stable volume was calculated by dividing the calculated amount of developer with the bulk density. Table 1 shows the relationship of the rotation speed of the stirring/conveying screw 25 and the feeding/conveying screw 26 with the stable volume.

TABLE 1

| ROTATION | DEVELOPER STABLE VOLUME [cc] | | |
|---|---|---|---|
| SPEED [rpm] | PRACTICAL EXAMPLE 1 | PRACTICAL EXAMPLE 2 | COMPARATIVE EXAMPLE |
| 139 | 155 | 155 | 159 |
| 278 | 150 | 150 | 166 |
| 449 | 148 | 148 | 171 |

As will be clear from Table 1, in Practical Example 1, where the shield portion 57 was provided over the downstream-side communication portion 20*f* and the gap d is formed over the shield portion 57, and in Practical Example 2, where the shield portion 57 was provided over the downstream-side communication portion 20*f* and the developer supply port 20*g* was arranged over the shield portion 57, even when the rotation speed of the stirring/conveying screw 25 and the feeding/conveying screw 26 was changed, the variation in the stable volume was small.

By contrast, in Comparative Example, where the shield portion 57 was not provided over the downstream-side communication portion 20*f*, the higher the rotation speed of the stirring/conveying screw 25 and the feeding/conveying screw 26, the larger the stable volume. These results confirm that, with the developing devices 3*a* of the Practical Example 1 and 2, compared with Comparative Example, even when the conveying speed of the developer changes, it is possible to keep the stable volume of the developer constant, and thus to effectively suppress development failure and the like due to an insufficient or excessive height of developer.

Example 2

The effect of suppressing scattering of toner in the developing devices 3*a* to 3*d* of the present disclosure was studied. The tests were conducted on the image forming portion Pa of cyan including the photosensitive drum 1*a* and the developing device 3*a*. The tests proceeded as follows. The developer containers 20 of the developing devices 3*a* of the Practical Example 2 and Comparative Example in Example 1 were each loaded with 175 cc of developer (with a toner concentration of 6%) and, in a normal-temperature and normal-humidity environment (25° C., 50%), a test image with a printing rate of 2% was continuously printed on 2000 sheets; thereafter a test image with a printing rate of 10%, 50%, and 80% were continuously printed on 500 sheets, and soiling with scattered toner from the developing devices 3*a* was visually checked. The results are shown in Table 2.

TABLE 2

| | PRINTING RATE [%] | | |
|---|---|---|---|
| | 10 | 50 | 80 |
| PRACTICAL EXAMPLE 2 | NO | NO | NO |
| COMPARATIVE EXAMPLE | NO | NO | YES |

As will be clear from Table 2, in Practical Example 2, where the developer supply port 20*g* is arranged over the shield portion 57, in all of the cases where the printing rate was 10%, 40%, and 80%, no scattering of toner was observed. By contrast, in Comparative Example, where neither of the shield portion 57 and the developer supply port 20*g* were provided or arranged over the downstream-side communication portion 20*f*, scattering of toner occurred in the case where the printing rate was 80%.

These results confirm that, with the developing device 3*a* of Practical Example 2 as compared with Comparative Example, owing to improved dispersibility of supplied developer and a stable amount of electric charge on toner, it is possible to suppress scattering of toner due to an insufficient amount of electric charge on toner.

The present disclosure is applicable to a developing device which supplies two-component developer containing toner and carrier and which discharges excessive developer, as well as to an image forming apparatus provided with such a developing device. Based on the present disclosure, it is possible to provide a developing device which can reduce variations in the height and weight of developer in a developer container even if the flowability or conveyance speed of developer changes.

What is claimed is:

1. A developing device comprising:

a developer container including first and second conveying chambers which are arranged parallel to each other, a first partition wall which partitions between the first and second conveying chambers along a longitudinal direction, a communication portion through which the first and second conveying chambers communicate with each other in opposite end parts of the first partition wall, a developer supply port through which developer containing magnetic carrier and toner is supplied, and a developer discharge portion which is provided in a downstream-side end part of the second conveying chamber and through which excessive developer is discharged;

a developer carrying member which is rotatably supported on the developer container and which carries, on a surface thereof, the developer in the second conveying chamber;

a first stirring/conveying member which includes a rotary shaft and a first conveying blade formed on an outer circumferential face of the rotary shaft and which stirs and conveys the developer in the first conveying chamber in a first direction; and a second stirring/conveying member which includes a rotary shaft and a second conveying blade formed on an outer circumferential face of the rotary shaft and which stirs and conveys the developer in the second conveying chamber in a second direction opposite to the first direction, wherein the second stirring/conveying member includes a regulating portion which is formed adjacent to the second conveying blade on a downstream side thereof in the second direction and which is composed of a conveying blade for conveying the developer in a direction opposite to the second conveying blade, and a discharging blade which is formed adjacent to the regulating portion on a downstream side thereof in the second direction and which conveys the developer in a same direction as the second conveying blade to discharge the developer through the developer discharge portion, the communication portion is composed of a first communication portion which, at a downstream side in the first direction, passes the developer from the first conveying chamber to the second conveying chamber, and a second communication portion which, at a downstream side in the second direction, passes the developer from the second conveying chamber to the first conveying chamber, the developer container includes a second partition wall which is arranged adjacent to the regulating portion on a downstream side of the second communication portion in the second direction to partition between the first conveying chamber and the regulating portion, and a shield portion which is connected to the first and second partition walls so as to bridge between the first and second partition walls and which shields a top part of the second communication portion, and a gap is formed between a top end part of the shield portion and an inner surface of the developer container.

2. The developing device according to claim 1, wherein the developer supply port is arranged over the shield portion.

3. The developing device according to claim 1, wherein the second stirring/conveying member includes a disk which is formed between the regulating portion and the second conveying blade perpendicularly to the rotary shaft, and the disk is arranged so that a position thereof in an axial direction falls within a region between a middle of the second communication portion in a width direction thereof and a downstream-side end part of the second communication portion with respect to the second direction.

4. The developing device according to claim 3, wherein the developer supply port is arranged over the shield portion, and the disk is arranged so that the position thereof in the axial direction is on an upstream side, with respect to the second direction, of a middle of the developer supply port in the axial direction.

5. The developing device according to claim 3, wherein an outer diameter of the disk is equal to or smaller than the outer diameter of the second conveying blade of the second stirring/conveying member.

6. The developing device according to claim 1, wherein a stepped part which is recessed upward is formed in the inner surface of the developer container facing an upper end part of the shield portion.

7. The developing device according to claim 1, wherein a lower end part of the shield portion is at a position overlapping a region between upper and lower end parts of the rotary shafts of the first and second stirring/conveying members.

8. The developing device according to claim 1, wherein the upper end part of the shield portion is within a range between above the rotary shafts of the first and second stirring/conveying members and below upper end parts of the first and second conveying blades.

9. The developing device according to claim 1, wherein a rotation speed of the first and second stirring/conveying members is switchable among a plurality of speeds.

10. An image forming apparatus comprising an image forming portion, the image forming portion forming an image on a recording medium, the image forming portion including an image carrying member on which an electrostatic latent image is formed, and a developing device according to claim 1 which develops the electrostatic latent image formed on the image carrying member into a toner image.

* * * * *